US008330396B2

(12) United States Patent
Mertens et al.

(10) Patent No.: US 8,330,396 B2
(45) Date of Patent: Dec. 11, 2012

(54) STARTING DEVICE WITH TWO INPUT POLES

(75) Inventors: Ferdinand Mertens, Arnsberg (DE); Reinhard Schauerte, Meschede (DE); Tobias Schulte, Meschede (DE)

(73) Assignee: Bag Electronics GmbH (DE)

( * ) Notice: Subject to any disclaimer, the term of this patent is extended or adjusted under 35 U.S.C. 154(b) by 256 days.

(21) Appl. No.: 12/863,115

(22) PCT Filed: Jan. 12, 2009

(86) PCT No.: PCT/EP2009/050246

§ 371 (c)(1),
(2), (4) Date: Aug. 9, 2010

(87) PCT Pub. No.: WO2009/090147

PCT Pub. Date: Jul. 23, 2009

(65) Prior Publication Data

US 2011/0115398 A1 May 19, 2011

(30) Foreign Application Priority Data

Jan. 17, 2008 (DE) ..... 10 2008 004 787

(51) Int. Cl.

| | |
|---|---|
| ***H01J 11/04*** | (2011.01) |
| ***H01J 13/48*** | (2006.01) |
| ***H01J 15/04*** | (2006.01) |
| ***H01J 17/36*** | (2006.01) |
| ***H05B 37/00*** | (2006.01) |
| ***H05B 39/00*** | (2006.01) |
| ***H05B 41/00*** | (2006.01) |
| ***G05F 1/00*** | (2006.01) |

(52) U.S. Cl. ..... 315/326; 315/291

(58) Field of Classification Search ..... 315/326
See application file for complete search history.

(56) References Cited

U.S. PATENT DOCUMENTS 5,319,285 A 6/1994 Wang et al.

(Continued)

FOREIGN PATENT DOCUMENTS

AU 698825 11/1998

(Continued)

OTHER PUBLICATIONS

International Search Report from corresponding PCT Application No. PCT/EP2009/050246 dated Mar. 26, 2009.

(Continued)

*Primary Examiner* — Shawki Ismail
*Assistant Examiner* — Dylan White
(74) *Attorney, Agent, or Firm* — Grossman Tucker Perreault & Pfleger PLLC

(57) ABSTRACT

A starting circuit arrangement in which a gas discharge lamp is assigned a supply circuit having at least one inductor arranged in series with the gas discharge lamp, wherein the starting circuit arrangement comprises a starting transformer connected on the primary side to a starting triggering circuit and connected on the secondary side to the lamp for the transmission of a starting pulse, an input energy source for the starting triggering circuit, a first switch means in the starting triggering circuit, an electronic control device which drives the first switch means. The starting circuit arrangement has, on the supply side, an input terminal connected in the supply circuit of the lamp between the inductor and the lamp, and a means provided for reproducing the phase profile of an AC supply variable of the lamp after starting of the lamp.

20 Claims, 3 Drawing Sheets

U.S. PATENT DOCUMENTS

| | | | | |
|---|---|---|---|---|
| 5,367,227 | A * | 11/1994 | Gademann et al. | 315/290 |
| 6,323,604 | B1 * | 11/2001 | Boenigk et al. | 315/290 |
| 2002/0047617 | A1 * | 4/2002 | Heckmann | 315/276 |
| 2008/0174252 | A1 * | 7/2008 | Mertens et al. | 315/290 |
| 2010/0237793 | A1 * | 9/2010 | Hasegawa et al. | 315/224 |
| 2012/0001560 | A1 * | 1/2012 | Newman et al. | 315/206 |
| 2012/0013263 | A1 * | 1/2012 | Fischer et al. | 315/219 |

FOREIGN PATENT DOCUMENTS

| | | |
|---|---|---|
| DE | 19531622 | 3/1997 |
| DE | 102004045834 | 3/2006 |
| DE | 102006034372 | 10/2007 |
| EP | 0337021 | 10/1989 |
| EP | 1133215 | 9/2001 |

OTHER PUBLICATIONS

English translation of International Preliminary Report on Patentability dated Aug. 19, 2010.

Search Report from corresponding German Application No. 10 2008 004 787.2, dated Jan. 17, 2008.

* cited by examiner

STARTING DEVICE WITH TWO INPUT POLES

FIELD

The invention relates to a starting circuit arrangement comprising the features of claim 1, for starting a gas discharge lamp and particularly for starting a high-pressure gas discharge lamp. The invention also relates to a method for starting such a lamp.

BACKGROUND

Conventional circuit arrangements for starting a gas discharge lamp which, in order to provide an AC supply voltage, is assigned a supply circuit, which has at least one inductor connected in series with the gas discharge lamp, are designed as heterodyne starting circuits. Such a starting circuit is disclosed for example in the German published patent application DE 19531622. It comprises a pulse transformer whose secondary side can be connected to the lamp for transmitting a starting pulse and whose primary side is connected to a starting triggering circuit for triggering a starting pulse. The starting triggering circuit includes an input energy source and a first switch means that is controlled by an electronic control device.

The timing of the starting process, particularly the generation of the starting pulses, is coupled to the phase position of the AC supply voltage to make sure that the starting pulses are generated at times at which the lamp can start and burn due to the instantaneous supply voltage. Moreover, conventional starting circuit arrangements provide that after the production of first starting pulses additional starting pulses are produced in a fashion adjusted to the AC supply voltage or that also other processes are initiated which assist the starting process.

In this respect, conventional starting circuit arrangements require the scanning of the instantaneous phase position of the AC supply voltage during or shortly after starting so that the starting process can be adjusted to it as described.

To this end, conventional starting circuit arrangements normally comprise at least three inputs which are directly connected to the phase of the AC supply voltage, to the output of the inductor respectively to the neutral conductor of the mains. The above-described applies to the connection to conventional single-phase mains. If the lamp and thus the starting circuit arrangement are operated on multi-phase mains, the first input terminal of the conventional starting circuit arrangement is connected to the L1 terminal of the mains, the second input terminal of the starting circuit arrangement is connected to the output of the inductor, and the third input terminal of the starting circuit arrangement is connected to the L2 terminal of the mains. Accordingly, in both cases the phase of the supply voltage can be scanned, thus providing for a starting control whose timing is adapted to the mains voltage.

FIG. 4*a* shows such a conventional starting circuit arrangement for starting a discharge lamp including three inputs B, L, N. The main voltage $U_N$ is applied to the input terminals L, N, and the lamp inductor 110 is connected in series with the input terminal B. The L input of the conventional starting device 100 on the one side serves to supplying the internal control circuit and on the other side to scanning the mains voltage so that the starting process can be synchronized with the mains voltage. On the output side, the starting device 100 includes two terminals to which the discharge lamp 3, e.g. a high-pressure gas discharge lamp, is connected.

Especially in applications in which the respective lamps are arranged remotely from the inductor of the supply circuit, this arrangement including a conventional starting circuit has disadvantages.

The complexity of the wiring at the use of such a conventional starting device is illustrated in FIG. 4*b* using floodlights as an example. The lamp inductor 110 is usually arranged in a distribution cabinet 105 which is usually placed with a distance to the light pole 120 and in which the lamp supply circuit is connected to the mains voltage. The distance between the distribution cabinet and the starting circuit may easily be more than 100 m. The pole carries a lamp array 130, and the associated starting device is arranged in direct neighborhood of the lamps. As it becomes apparent from the described illustration, the line 140 between the distribution cabinet and the lamp 130 must have a three-pole design, since the conventional starting device includes an inductor terminal as well as the input terminals L, N for the mains voltage $U_N$.

The fact that conventional starting circuit arrangements usually have three input terminals means that the wiring is very complex.

SUMMARY

Accordingly, it is an object of the present invention to remove or at least reduce the above-described disadvantage of conventional starting circuit arrangements for gas discharge lamps and in particular for high-pressure gas discharge lamps.

On part of the device, this object is already achieved in a surprisingly easy way by a starting circuit arrangement including the features of claim 1. The starting circuit arrangement according to the invention is characterized in that it can be connected on the supply side between the inductor and the lamp in the lamp supply circuit and that a means is provided for reproducing the phase profile of an AC supply variable of the lamp after its starting, in particular in order to determine a zero crossing of the AC supply variable. The AC supply variable may for instance be the mains voltage or the mains current.

By designing the starting circuit arrangement in compliance with the invention, direct coupling of the starting circuit to the AC supply can be omitted, since the starting circuit arrangement can be connected on the supply side between the inductor and the lamp within the lamp supply circuit and the time profile of the AC supply can be simulated using corresponding means. By the omission of the L terminal on the starting circuit arrangement according to the invention, a line can be saved, e.g. the line between a distribution cabinet in which the supply inductor is arranged and a light pole on which the lamps and the associated starting circuit arrangement are installed.

The above expression " . . . after starting of the lamp" means a time period or a point of time in or at which the gas discharge in the lamp has started at least in a part of the gas volume. This expression also means a starting situation in which the lamp has fully started, but in which the gas discharge still is comparatively instable, thus involving the risk that the discharge is extinguished again. Accordingly, the starting process by the starting device of the invention is completed only after the gas discharge burns stably and if there is no more risk for the discharge to extinguish. Compared to conventional starting circuit arrangements which are cut off after starting the gas discharge, the starting circuit arrangement of the invention can be stabilized by generating additional starting pulses even during the transitional phase and until the gas discharge burns stably. By the fact that the starting circuit arrangement of the invention is designed for reproducing the phase profile of an AC supply variable of the lamp over several periods of the AC supply variable after starting of the lamp, these starting pulses can be produced even during the above-described transitional phase from partial discharge until stable discharge, in a fashion adapted to the time profile of the AC supply variable of the lamp. This transitional phase in which the reproduction of the phase profile of the AC supply variable takes place, can be adapted to the respective circumstances. Depending on the design, the starting circuit arrangement of the invention can be preferably configured for reproducing the phase profile of the AC supply variable of the lamp up to 5, 10, 15, 20 or 30 periods or even more periods of the AC supply variable after the partial ignition of the discharge.

Advantageous embodiments are stated in the subclaims.

It can be useful to provide a means for detecting the instantaneous value of an AC supply variable of the lamp, in particular a voltage like the mains voltage or a current, at a detection point between the inductor and the lamp in the supply circuit. Most expediently, the detection means is connected on the signal output side to the signal input of the control device, so that the control device can process the signal. The detection means enables for example the determination of the phase position of the mains voltage prior to starting of the lamp, and the determined phase position can then be used for the timing control of the starting process after or during starting of the lamp. Additionally, the detection means enables the detection of up-to-date process parameters such as the lamp voltage or the lamp current also during the starting process.

In order to provide the input energy source for the starting triggering circuit of the starting circuit arrangement of the invention, a supply line of the input energy source for the starting triggering circuit can be connected in the lamp supply circuit between the inductor and the lamp. The invention may also provide that the input energy source for the starting triggering circuit is controllable by the control device.

It is particularly advantageous to provide a current path bypassing the gas discharge lamp for charging the inductor, the said current path comprising a second control means which is driven by the control device. This design of the device enables the provision of an additional electric supply of the lamp during the starting process beyond the actual AC supply of the lamp, so that it is more likely that the discharge of the lamp can be often initiated and maintained already at the first starting attempt. The triggering of the second switch means is advantageously synchronized with the reproduced phase profile of the AC supply variable, possibly again over several periods of the AC supply variable.

To provide for a supply of the electronic control device independently of the operating condition of the lamp, it may be advantageous for a supply line of the electronic control device in the supply circuit of the lamp to be connectible between the inductor and the lamp and to be connected to a converter circuit supplying the control device. Advantageously, this converter circuit can be arranged for converting the mains voltage which is applied prior to starting of the lamp and also the voltage which is applied after starting and which is dependent on the operation of the lamp into a predetermined, constant supply voltage of the control device.

As already explained, it may be advantageous for the inductor to provide additional electric energy for assisting the starting process. To this end, it may be expedient for the second switch, after starting of the lamp, to be driven for closing when the reproduced AC supply variable approximately reaches the zero crossing and then again for opening before the expiration of a quarter period. In this connection it is particularly advantageous if the second switch is driven for closing 10 to 20 degrees before or after reaching the zero crossing and most expediently 0 to 10 degrees before or after reaching the zero crossing. Ideally, after starting of the lamp, the second switch is driven for closing approximately 0 to 5 degrees before or after reaching the zero crossing. Accordingly, the control of the switch is synchronized with the reproduced AC supply variable, e.g. with the reproduced mains voltage.

It turned out to be useful for the second switch to be driven for closing after starting of the lamp over several periods in the region of the zero crossing of the reproduced AC supply variable and for opening before the expiration of a quarter period. In a particularly advantageous embodiment, the second switch can be driven in the manner as described over and up to 20 periods or even longer. The described opening and closing of the second switch over several periods assists discharging and thus reduces the time until the desired stable gas discharge is achieved in the lamp. It can be provided that in addition to the opening and closing of the second switch even further starting pulses are produced over a predetermined period of time in a manner adapted to the reproduced phase profile of the AC supply variable of the lamp.

Advantageously, the means for reproducing the phase profile of the AC supply variable of the lamp can include an adjustable frequency generator which is connected for example on the signal side to or integrated in the control device. Advantageously, the clock frequency of the generator before the actual starting process can be adjusted to the mains frequency and the generator can be synchronized with the mains voltage, so that the generator provides a reproduction of the mains voltage on its output during or after the starting process. In this period of time in which the supply voltage of the lamp cannot be measured by the starting device according to the invention, it is nevertheless guaranteed that the control of the starting process can be synchronized with the supply voltage of the lamp, i.e. with the mains voltage.

Advantageously, the starting circuit arrangement of the invention can comprise precisely two input terminals to be connected to two different input potentials. The L terminal to be provided in conventional starting circuit arrangements may be omitted. Moreover, it can be advantageous if the starting circuit arrangement of the invention comprises also only two output-side terminals to which the lamp can be connected.

On part of the method, the invention solves the above-mentioned problem by a method comprising the features of claim 10, for starting a gas discharge lamp. The method according to the invention is characterized in that the starting circuit arrangement is connected on the supply side between the inductor and the lamp, wherein after starting of the lamp the phase profile of an AC supply variable, particularly the AC voltage applied to the supply circuit, is reproduced, e.g. determining the zero crossings of the AC supply variable and controlling the timing of the starting process depending on the reproduced phase profile of the AC supply variable. Due to the method according to invention, direct scanning of the mains voltage with which the supply circuit of the lamp is operated is unnecessary for controlling the staring process, since the reproduced supply variable is available for this purpose. According to the invention, the time profile of the AC supply variable is reproduced particularly at such points of time at which the discharge of the lamp has already started, but is not yet completed and stable. In such a condition of operation of the lamp, the time profile of an AC supply variable of the lamp, such as the mains voltage in the supply circuit between the inductor and the lamp, cannot be scanned. This is compensated for by the inventive reproduction of the phase profile of the AC supply variable of the lamp.

The generation of a starting pulse can be synchronized for example with the reproduced AC supply voltage in such a manner that the starting pulse is generated when the instantaneous value of the supply voltage is above the lamp burning current.

It is particularly beneficial if the method according to the invention automatically adapts itself to the respective frequency of the mains of the discharge lamp. To this end, it can be provided that the frequency of the AC supply voltage is scanned prior to starting of the lamp. This scanning can be performed prior to starting of the lamp at a measuring point which is provided between the series-connected inductor and lamp, since there is no flow of lamp current and thus the sinus of the supply frequency can be scanned unaltered even behind the inductor on the supply side. While obtaining a similar advantage, it can also be beneficial to scan the phase position of an AC supply variable, e.g. the phase position of the mains voltage, prior to starting of the lamp. In this case, too the supply voltage between the lamp and the inductor can be scanned due to the lacking current flow prior to starting of the lamp, so that the L line can be omitted which is otherwise required between the starting circuit arrangement and the distribution cabinet accommodating the inductor.

Advantageously, the scanned phase position of the AC supply variable, in particular the AC supply voltage and the scanned frequency, can be used for reproducing the AC supply variable, so that this reproduction is then available for controlling the timing of the starting process. In this connection it is particularly useful if a frequency generator is started, which is operated with the frequency of the AC supply voltage, and the frequency generator is synchronized with the phase position of the AC supply variable, in particular with the zero crossing of the AC supply variable, prior to starting of the lamp. To this end, the frequency generator is most expediently driven using the scanned phase position and the frequency of the AC supply variable, so that the output of the frequency generator delivers a reproduction of the AC supply variable, in particular of the mains voltage, the reproduction of the AC supply variable being used for the control of the timing of the starting process.

In addition to the synchronization of the starting pulses with the reproduced AC supply variable or its phase position, also other processes can be synchronized with the reproduced AC supply variable during and/or after starting of the lamp. It should be noted that the term "synchronizing" normally denotes the coordination of the timing of processes. It can be useful for example if for assisting the starting process an inductor which is connected in the supply circuit in series with the lamp is charged before the generation of a starting pulse and if at least a part of the energy stored in the inductor is superposed on the AC supply of the lamp during the starting process. In this case, even the beginning or the end of charging of the inductor is advantageously adapted to the simulated profile of the AC supply variable or is synchronized with the same. It can be useful for this purpose if after starting of the lamp a charging path is connected for the inductor when the instantaneous value of the reproduced AC supply variable reaches a predetermined value, particularly the value of zero, and is opened again within a quarter period.

Similarly, it can be useful to synchronize the charging of an input energy source for a starting triggering circuit of the starting circuit arrangement with the reproduced phase profile of the AC supply variable of the lamp. This process must be respectively performed prior to triggering a starting pulse, charging of the input energy source of the starting triggering circuit according to the invention taking place at such points of time at which the energy provided by the supply is not completely needed for the burning operation of the lamp. This prevents the lamp from being unintentionally extinguished by charging the input energy source whose energy is also taken from the supply circuit of the lamp.

For detecting possible wiring faults at the connection of the starting circuit arrangement of the invention to the lamp, it can be useful if prior to the activation of the starting circuit arrangement of the invention and with the supply voltage applied to the gas discharge lamp, a current path bypassing the lamp is connected through particularly in the region of the zero crossing of supply voltage and the flowing bridge current is detected, e.g. measured, and the starting circuit arrangement is blocked if the detected bridge current in the bypassed current path exceeds a predetermined threshold. This predetermined threshold corresponds to a value which occurs in the case of a faulty wiring of the starting circuit arrangement of the invention with the mains or the inductor. Such a wiring fault exists for example if the phase connection, i.e. the B terminal of the starting circuit arrangement is not connected to the output of the inductor, but directly to the mains voltage (L). The lacking inductor in the supply circuit of the lamp then becomes noticeable by an increased bridge current whose detection results in blocking the starting circuit arrangement. In this connection, it is particularly useful if the current path which can be connected through is identical with the above-mentioned switchable current path for charging the inductor, which means that according to the invention a switch for enabling the current path can be used for both functions.

BRIEF DESCRIPTION OF THE DRAWINGS

In the following, embodiments of the invention will be described with reference to the attached drawing figures wherein it is shown by FIG. 1 in a block diagram, a starting circuit arrangement of the invention, with two input and two output poles.

DETAILED DESCRIPTION

Figure 1:
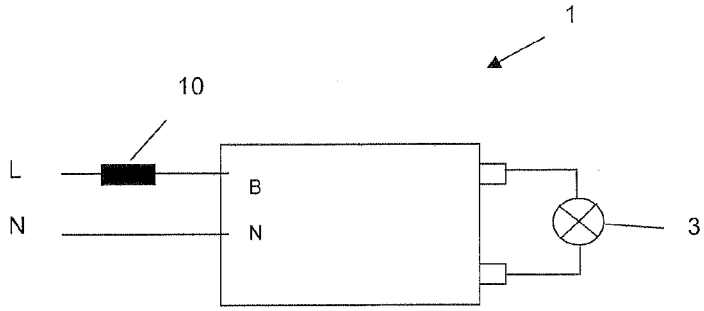

A starting device 1, which is designed according to the invention, is shown in FIG. 1. It can be seen that this starting device comprises only two input terminals, namely for the connection to the lamp inductor 10 and to the N conductor of the AC supply. Since the connection to the L conductor of the AC supply is omitted, the wiring for a conventional starting device illustrated in FIG. 4 allows line 140 to have a two-pole design instead of a three-pole design.

Figure 2:
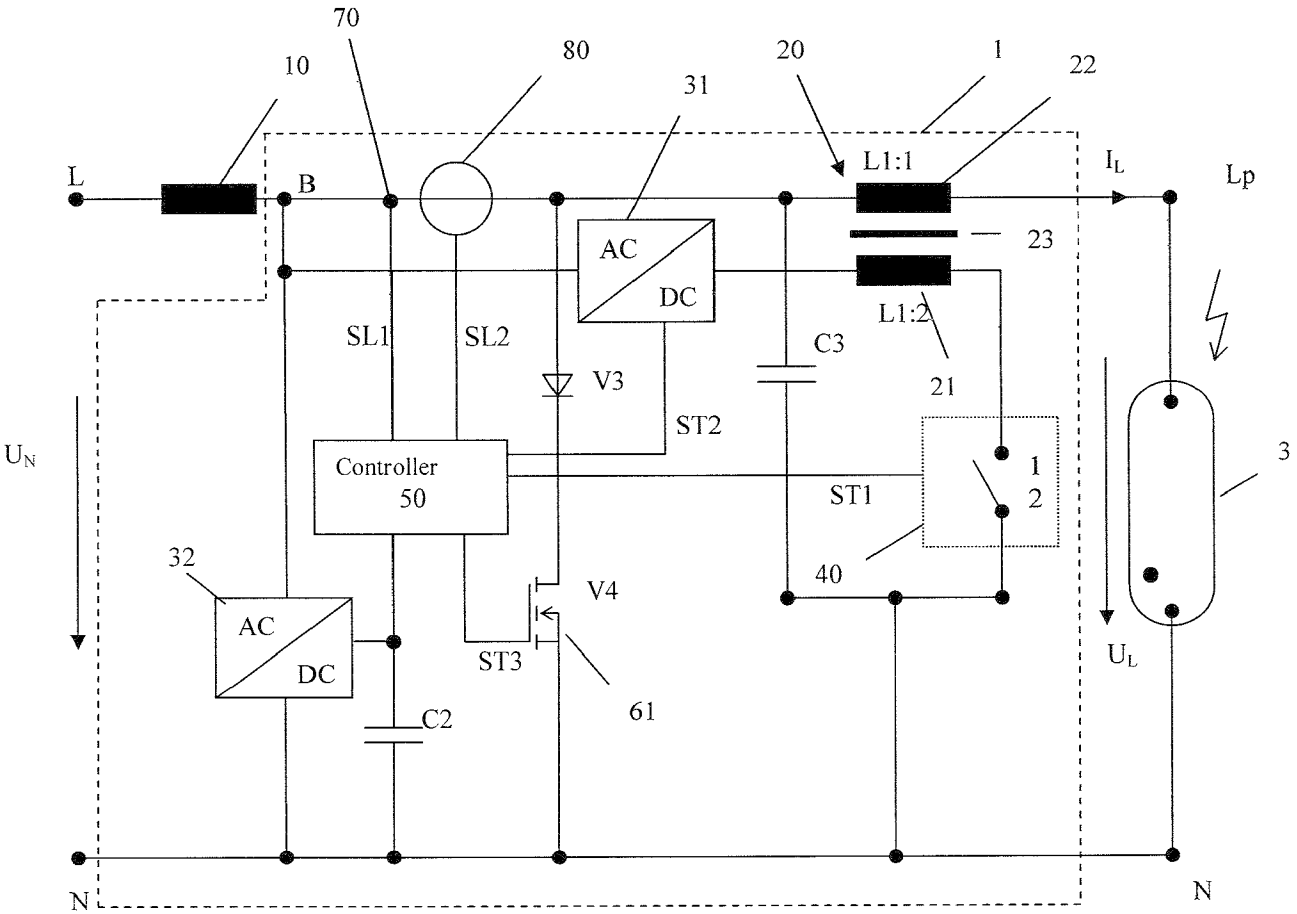
FIG. 2 a starting circuit arrangement according to the invention in a detailed presentation.

FIG. 2 shows a detailed presentation of the starting circuit arrangement of the invention. The same has the input terminals B, N on the input side. In the described embodiment, the lamp inductor 10 is connected outside of the starting device between the input terminal L of the AC supply and the input terminal B of the starting device 1. On the output side, the starting device 1 has two terminals LP, N to which the lamp 3 is connected.

The starting circuit arrangement includes a trigger transformer 20 which with its primary winding 21 forms a part of a starting triggering circuit including as main components a controllable rectifier 31 as an input energy source, the primary-side coil 21 and the switch 40. Both the input energy source 31 and the switch 40 are driven by a controller 50 through control lines ST1 or ST2. The controller 50 adjusts the output of the input energy source 31 and initiates the generation of a pulse in the starting triggering circuit by closing switch 40.

The primary-side coil winding 21 is coupled through the trigger transformer core 23 to the secondary-side coil winding 22, which serves the transmission and transformation of the pulse and which is connected in series with the lamp and the inductor 10. The supply circuit of the lamp in the described embodiment accordingly comprises the series connection of the inductor 10, the secondary-side coil winding 22 and the lamp itself.

In the described embodiment, the input energy source 31 of the starting triggering circuit is coupled to the terminal B of the starting device 1, i.e. to the output of the inductor 10. The input energy source for the starting triggering circuit (31, 21, 40), which is designed as a controllable rectifier 31, is so dimensioned that it is capable of providing the energy required for generating the starting pulse. In a similar manner, the rectifier 32 is connected to the input B of the starting circuit arrangement which provides the supply for the operation of the controller 50.

The controller 50 senses the instantaneous voltage at the terminal B in the described embodiment using the sensor line SL1 between the inductor 10 and the lamp and the instantaneous current, e.g. the flowing lamp current IL, using the sensor line SL2, after the lamp has started.

Moreover, the starting circuit arrangement illustrated in FIG. 2 includes a current path (V3, V4) which bypasses the lamp 3 and with which the inductor 10 can be charged by means of the mains voltage $U_N$ independently of the lamp and of the triggering circuit by operating switch 61. To this end, the controller 50 is connected to the gate of the switch 61 via the control output ST3.

Moreover, a parallel connection of a capacitor C3 with the lamp 3 is provided and serves as a high-frequency feedback capacitor device, in order to prevent the inductor 10 from being burdened with the high-voltage starting pulse. Moreover, prior to the starting and after charging the inductor 10, a part of the energy there stored is reloaded to the capacitor C3, this additional energy serving to assist the development of the discharge in the lamp 3 during the starting process.

The operation of the starting circuit arrangement of the invention illustrated in FIG. 2 will be described in the following. As already mentioned above, both the controller 50 and the input energy source 31 of the starting triggering circuit are not operated directly through the mains supply voltage L, but via a connection in the supply circuit of the lamp which is arranged between the inductor 10 and the lamp 3. In the described embodiment, this connection is provided at the output of the inductor 10 directed toward the lamp 3. According to the invention, the potential which is available at this output is used for the electric supply of the starting circuit arrangement.

The mains voltage or its phase position can be sensed via the sensing line SL1 only as long as the lamp 3 is not started. After starting, SL1 substantially senses the lamp voltage of the discharge lamp. However, for controlling the entire starting process, information on the phase position of the mains voltage is required, especially information on the zero crossing of the mains voltage. For this purpose, the controller 50 in the described embodiment of the invention reproduces the phase position of the mains voltage. To this end, the mains frequency is detected by the controller 50 via line SL1 prior to starting, and an internal frequency generator of the controller 50 is operated with the detected mains frequency. Thereafter, the internal, reproduced AC supply variable is synchronized with the mains frequency detected via sensor line SL1. The mains voltage $U_N$, e.g. a sinusoidal alternating voltage of 50 Hz, is completely synchronously reproduced in the controller 50, so that the internal frequency generator delivers a corresponding 50 Hz sine frequency oscillation which corresponds any time to the oscillation of the mains.

Thereafter, the actual starting process can be initiated. In the embodiment illustrated in FIG. 2, for assisting the starting process, the lamp inductor 10 is charged over a predetermined time and thus with a predetermined electric energy, by driving the switch 61 for closing the charging path (10, V3, 61). The controller 50 drives the gate of the switch 61 via the control line ST3. A charging current flows via the switch 61 to the inductor 10, which takes up energy. After reaching a predetermined amount of energy, the switch 61 is opened again. Thereafter, the capacitor C3 can be charged via the mains and the energy previously stored in the inductor 10.

The timing of the charging of the inductor 10 via the charging path by means of the switch 61 as well as the subsequent charging of the storage capacitor C3 takes place synchronously, i.e. synchronized in time with the mains voltage $U_N$ reproduced in the controller 50. At a point of time, at which the mains voltage reproduced in the controller 50 is above the lamp operating voltage, the switch 40 is activated and again deactivated for a period of approx one micro second for closing and opening the switch one time. Thus the rectifier 31 which functions as an input energy source for the starting triggering circuit drives the starting triggering circuit via the primary-side coil winding 21 of the trigger transformer 20, thus producing a primary-side pulse. The magnetization of the primary-side coil winding is transferred via the trigger transformer core 23 to the secondary-side coil winding 22 with the transformation ratio of the trigger transformer and is superposed as a starting pulse on the mains voltage. Accordingly, a secondary-side pulse is applied to the lamp, so that the lamp can start.

Depending on the embodiment, it is readily possible in the starting circuit arrangement of the invention to produce several single primary-side pulses synchronized in time with the AC supply variable reproduced in the controller 50, thus facilitating the lamp starting process. In this connection, it is possible for example to generate several starting pulses within one half period of the reproduced mains voltage or also to respectively produce several starting pulses within successive periods of the AC supply variable reproduced in the controller 50. This technique is beneficial especially in a case in which the first starting pulse has produced only a partial ionization of the gas of the discharge lamp 3, but not yet a complete or stable discharge. Depending on the embodiment of the invention, in order to stabilize the discharge, additional starting pulses can be produced preferably over a time period of 3, 5, 10, 20 or more periods after the partial ionization of the gas of the discharge lamp, in a fashion synchronized with the reproduced AC supply variable.

Moreover, the energy additionally available for discharge during the starting process can be fixed via the controller 50 by adjusting the charging time for the controlled charging of the inductor 10 dependent on the dimensioning of the inductor and the capacitor C3. Insofar, the various starting parameters are very precisely adjustable depending on the connected lamp, thus enabling reliable starting of the lamp with as little energy and wiring as possible and irrespective of whether the lamp has to be started in the hot or cold state. The starting device can be designed in such a manner that the control can recognize if hot starting is required and thereupon adjust the starting parameters such as the switching times of the two switches 40, 61, the number of the primary-side pulses, the level of the input voltage of the triggering circuit etc.

The starting circuit arrangement illustrated in FIG. 2 is arranged for producing starting pulses within a positive half wave of the supply voltage $U_N$. In one embodiment of the starting device of the invention which is not illustrated, starting pulses are produced within successive adjacent half waves of the reproduced supply voltage. Furthermore, it turned out that the starting process can be further improved by controlling the second switch 61 for closing after starting the lamp, if the reproduced AC supply variable approximately reaches the zero crossing and thereafter controlling the switch 61 again for opening before the expiration of a quarter period. Thus the energy which is available for starting or maintaining the discharge process in the lamp 3 can be increased, so that adjusting of the discharge is simplified even under difficult conditions. If the starting conditions are particularly difficult, this process can be performed also over several periods of the supply voltage reproduced in the controller, i.e. controlling the switch 61 for closing when the reproduced variable approximately reaches the zero crossing and then for opening before the expiration of a quarter period. Since the mains voltage is not applied across the sensor line SL1 during the starting operation and since it is approximately the lamp voltage that can be sensed there, the invention provides that the timing of the starting phase is synchronized with the supply voltage $U_N$ reproduced in the controller 50, i.e. the time profile is adapted to the reproduced variable, so that the starting circuit arrangement of the invention can do without an L input.

Figure 3:
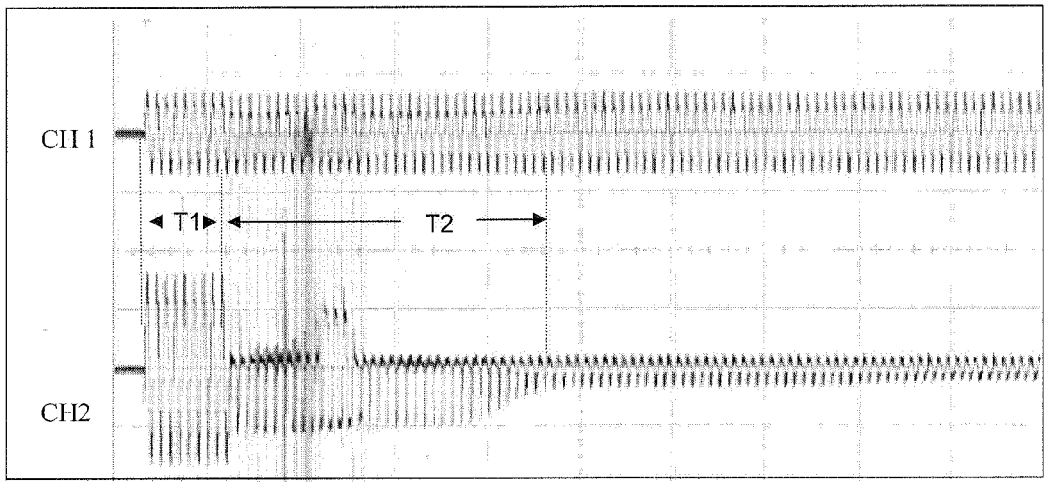
FIG. 3 an oscilloscope diagram of a real supply voltage and of the supply voltage reproduced in the starting circuit arrangement according to the invention.
Figure 4B:
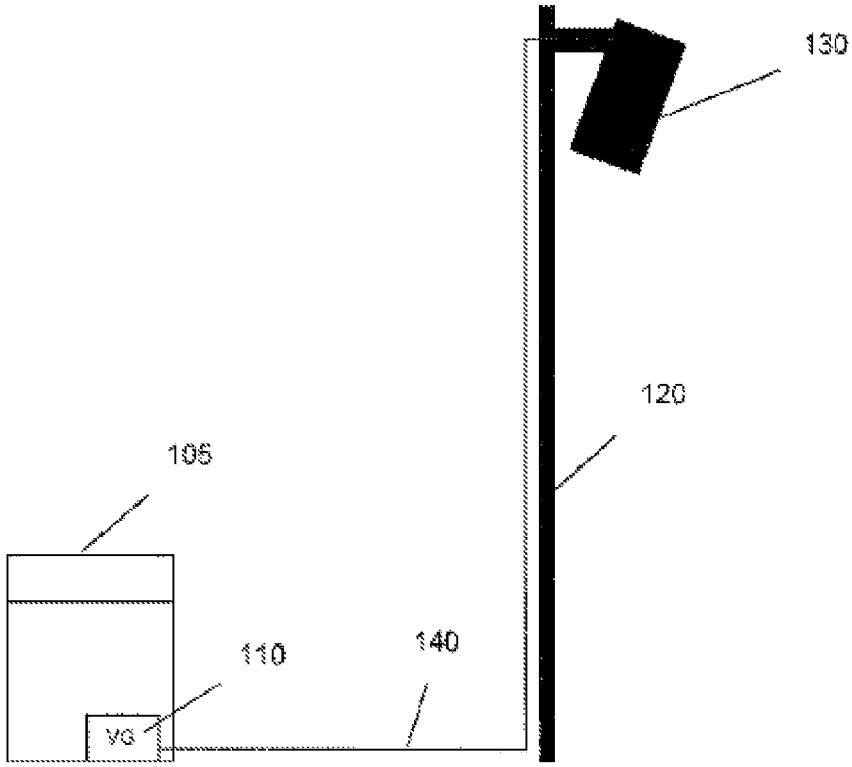
FIG. 4B PRIOR ART
FIG. 4*a* a block diagram of a conventional starting circuit arrangement with three input and two output poles and FIG. 4*b* the wiring required for a flood light system using a conventional starting circuit arrangement.
Figure 4A:
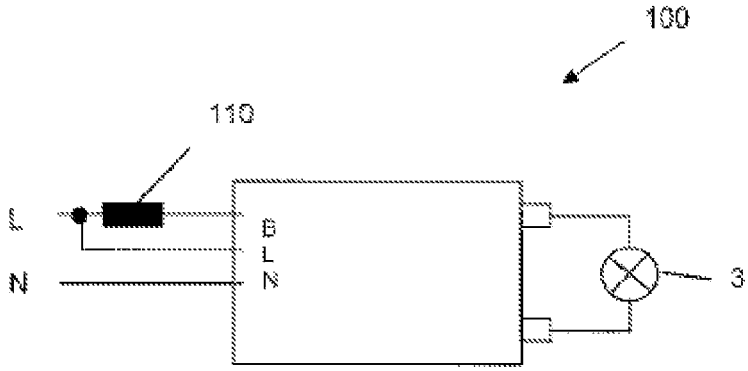
FIG. 4A PRIOR ART

FIG. 3 illustrates an oscillogram of the lamp voltage (CH) that can be sensed at point B (see FIG. 2) and of the AC supply variable (CH 1) reproduced in the controller 50 and corresponding to the mains voltage $U_N$. Prior to making the oscillograms, the reproduced AC supply variable (CH 1) was synchronized with the mains voltage $U_N$. Within the time period T1, the reproduced AC supply variable and the voltage sensed at B operate synchronously, i.e. the lamp 3 does not burn during this time period. The time period T2 describes the actual starting process. FIG. 4 shows that a time period of many cycle frequencies is required until the lamp burns stably at the end of T2. Within this time period T2, for adjusting the discharge, switches 40, 61 of the starting circuit arrangement of the invention are driven synchronously, i.e. adapted in time to the supply voltage reproduced in the controller 50, in order to produce several starting pulses on the one side and on the other side to provide more energy for the lamp by means of the inductor during the production of these starting pulses respectively, to assist the starting process. After the expiration of the time period T2, which in the stated example comprises more than 30 periods of the mains voltage, a stable lamp discharge has established, so that the starting circuit arrangement of the invention can be cut off with the termination of the starting process.

In a similar manner, in the starting circuit arrangement according to FIG. 2, after starting the lamp, charging the input energy source (31) for the starting triggering circuit (21) of the starting circuit arrangement is synchronized with the reproduced phase profile of the AC supply variable of the lamp. This process must be respectively performed prior to triggering a starting pulse, while according to the invention charging of the input energy source of the starting triggering circuit takes place at such points of time at which the energy provided by the supply is not completely required for burning of the lamp. To this end, the controller 50 controls the rectifier 31 via the control signal ST2. This measure avoids that the lamp is unintentionally extinguished due to the charging of the input energy source 31 whose energy is also taken from the supply circuit of the lamp.

For detecting possible wiring faults during the connection of the starting circuit arrangement of the invention as illustrated in FIG. 2, prior to the production of starting pulses with the supply voltage $U_N$ applied across the supply circuit of the gas discharge lamp, a current path (V3, V4) bypassing the lamp is connected through in the region of the zero crossing of the supply voltage $U_N$ and the flowing bridge current is measured through the flow measuring means 80 and the starting circuit arrangement 1 is blocked when the detected bridge current in the bypassed current path exceeds a predetermined threshold. This threshold occurs if the B terminal of the starting circuit arrangement is not connected at the output of the inductor 10, but directly to the mains voltage (L). The lacking inductor 10 in the supply circuit of the lamp 3 becomes noticeable through an increased bridge current after whose detection the starting circuit arrangement is blocked by the controller 50, so that no starting pulses are produced. The current path (V3, V4) is switched by the switch 61, which is also used for charging the inductor 10.

LIST OF REFERENCE NUMBERS

1 starting circuit arrangement/starting device
3 gas discharge lamp
10 energy storage, lamp inductor
20 trigger transformer
21 primary-side coil winding/coil
22 secondary-side coil winding/coil
23 trigger transformer core
31 controllable rectifier
32 controllable rectifier
40 first switch means
50 control means, controller
61 second switch means, field effect transistor
70 detection means for the instantaneous value of the mains voltage
80 detection means for the charging current/lamp current
105 distribution cabinet
110 lamp inductor
120 pole
130 lamp array $I_L$ lamp current
140 three-pole line
SL1, SL2 sensor line
ST1, ST2, ST3 control line
T1 time period prior to starting the lamp
T2 time period after starting the lamp
$U_L$ lamp voltage
$U_N$ mains voltage (sinusoidal)

What is claimed is:

1. A starting circuit arrangement for starting a gas discharge lamp, particularly for starting a high-pressure gas discharge lamp, wherein the lamp, in order to provide an AC supply voltage, is assigned a supply circuit, which at least includes an inductor arranged in series with the gas discharge lamp, the starting circuit arrangement comprising:

a trigger transformer which is connectible on the primary side to a starting triggering circuit and on the secondary side to the lamp, for transmitting a starting pulse;

an input energy source for the starting triggering circuit;

a first switch means in the starting triggering circuit; and an electronic control means driving the first switch means, wherein the starting circuit arrangement comprises on the supply side an input terminal connectible in the supply circuit of the lamp between the inductor and the lamp and that a means is provided for reproducing the phase profile of an AC supply variable of the lamp after starting of the lamp, especially for detecting a zero crossing of the AC supply variable of the lamp after starting the lamp.

2. The starting circuit arrangement according to claim 1, comprising a means for detecting the instantaneous value of an AC supply variable (voltage/current) of the lamp at a detection point in the supply circuit which lies between the inductor and the lamp.

3. The starting circuit arrangement according to claim 1, wherein in that in the supply circuit of the lamp, between the inductor and the lamp, a supply line of the input energy source for the starting triggering circuit is connected and that the input energy source for the starting triggering circuit is controllable by a control device.

4. The starting circuit arrangement according to claim 1, wherein a current path bypassing the gas discharge lamp is provided for charging the inductor, said current path comprising a second switch means, which is driven by the control device.

5. The starting circuit arrangement according to claim 1, wherein a supply line of the electronic control means in the supply circuit of the lamp is connectible between the inductor and the lamp and is connected to a rectifier means which supplies the control device and which transforms a voltage which is dependent on the operation of the lamp into a predetermined, constant supply voltage of the control device.

6. The starting circuit arrangement according to claim 1, wherein the second switch, after starting of the lamp, is driven for closing when the reproduced AC supply variable (voltage/current) approximately reaches the zero crossing and is driven again for opening before the expiration of a quarter period.

7. The starting circuit arrangement according to claim 6, wherein the second switch, after starting of the lamp, is respectively driven for closing over several periods in the region of the zero crossing of the reproduced AC supply variable and for opening before the expiration of a quarter period.

8. The starting circuit arrangement according to claim 1, wherein the means for reproducing the phase profile of an AC supply variable of the lamp comprises an adjustable generator.

9. The starting circuit arrangement according to claim 1, wherein the starting circuit arrangement includes precisely two input terminals to be connected with different input potentials.

10. A method for starting a gas discharge lamp, particularly a high-pressure gas discharge lamp which, in operation, is supplied with energy by means of an AC supply circuit comprising a lamp inductor, wherein at least one starting pulse is generated by means of a starting circuit arrangement comprising a trigger transformer, wherein, on the supply side, the starting circuit arrangement is connected between the inductor and the lamp and that after starting of the lamp the phase profile of an AC supply variable of the lamp is reproduced, especially detecting zero crossings and controlling the timing of the starting process depending on the reproduced phase profile of the AC supply variable.

11. The method according to claim 10, wherein the generation of a starting pulse is synchronized with the reproduced phase profile of the AC supply variable.

12. The method according to claim 10, wherein prior to starting of the lamp, the phase position of an AC supply variable is scanned at a measuring point arranged between the inductor and the lamp.

13. The method according to claim 10, wherein prior to starting of the lamp, the frequency of the AC supply voltage is scanned at a measuring point arranged between the inductor and the lamp.

14. The method according to claim 10, wherein a frequency generator is started which is operated with the frequency of the AC supply voltage, wherein the frequency generator, prior to starting of the lamp, is synchronized with the phase position of an AC supply variable, particularly with a zero crossing of the AC supply variable.

15. The method according to claim 10, wherein in consideration of the phase position scanned prior to starting of the lamp and the frequency of an AC supply variable a frequency generator is driven after starting of the lamp, for reproducing the phase position of the AC supply variable.

16. The method according to claim 14, wherein after starting of the lamp, the time profile of an instantaneous value of a timed AC supply variable, particularly the time profile of the AC supply voltage, is reproduced in consideration of the reproduced phase position.

17. The method according to claim 10 for assisting the starting process, an inductor arranged in the supply circuit is charged prior to the generation of the at least one starting pulse and that at least a part of the energy stored in the inductor is superposed on the AC supply of lamp during the starting process.

18. The method according to claim 17, wherein after starting of the lamp, a charging path for the inductor is connected when the instantaneous value of a reproduced AC supply variable reaches a predetermined value, particularly the value of zero, and is opened again within a quarter period.

19. The method according to claim 10, wherein after starting of the lamp, the charging of an input energy source for a starting triggering circuit of the starting circuit arrangement is controlled in a fashion synchronized with the reproduced phase profile of the AC supply variable of the lamp.

20. The method according to claim 10, wherein prior to the activation of the starting circuit arrangement, with the supply applied to the gas discharge lamp, a current path bypassing the lamp is connected through and the flowing bridge current is detected and the starting circuit arrangement blocked when the detected bridge current exceeds a predetermined threshold.

* * * * *

UNITED STATES PATENT AND TRADEMARK OFFICE

CERTIFICATE OF CORRECTION

PATENT NO. : 8,330,396 B2
APPLICATION NO. : 12/863115
DATED : December 11, 2012
INVENTOR(S) : Ferdinand Mertens et al.

It is certified that error appears in the above-identified patent and that said Letters Patent is hereby corrected as shown below:

In column 11, line 17, in Claim 3, delete "in that in" and insert -- in --, therefor.

Signed and Sealed this
Ninth Day of April, 2013

Teresa Stanek Rea
*Acting Director of the United States Patent and Trademark Office*